US009502789B2

(12) United States Patent
Umlauf et al.

(10) Patent No.: US 9,502,789 B2
(45) Date of Patent: Nov. 22, 2016

(54) ELECTRICAL CONNECTOR

(71) Applicant: 3M INNOVATIVE PROPERTIES COMPANY, St. Paul, MN (US)

(72) Inventors: Thomas E. Umlauf, Austin, TX (US); Walter R. Romanko, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 95 days.

(21) Appl. No.: 14/359,047

(22) PCT Filed: Nov. 20, 2012

(86) PCT No.: PCT/US2012/066003

§ 371 (c)(1),
(2) Date: May 16, 2014

(87) PCT Pub. No.: WO2013/078169

PCT Pub. Date: May 30, 2013

(65) Prior Publication Data

US 2014/0322990 A1 Oct. 30, 2014

Related U.S. Application Data

(60) Provisional application No. 61/563,342, filed on Nov. 23, 2011.

(51) Int. Cl.

| | |
|---|---|
| ***H01R 4/36*** | (2006.01) |
| ***H01R 11/09*** | (2006.01) |
| ***H01R 4/30*** | (2006.01) |

(52) U.S. Cl.

CPC ..... *H01R 4/36* (2013.01); *H01R 4/304* (2013.01); *H01R 11/09* (2013.01)

(58) Field of Classification Search

CPC ..... H01R 4/66; H01R 13/52; H01R 11/09
USPC ..... 439/797, 271
See application file for complete search history.

(56) References Cited

U.S. PATENT DOCUMENTS

| | | | | |
|---|---|---|---|---|
| 7,438,607 | B2 * | 10/2008 | Fong | H01R 4/36 439/798 |
| 7,537,494 | B1 * | 5/2009 | Umlauf | H01R 4/36 439/798 |
| 7,896,714 | B2 * | 3/2011 | Moist | H01R 4/36 439/271 |
| 7,931,508 | B1 * | 4/2011 | Carr | H01R 4/36 439/798 |

(Continued)

OTHER PUBLICATIONS

International Search Report for PCT International Application No. PCT/US2012/066003 mailed on May 15, 2014, 3 pages.

*Primary Examiner* — Tho D Ta
*Assistant Examiner* — Nader Alhawamdeh
(74) *Attorney, Agent, or Firm* — Gregg H. Rosenblatt

(57) ABSTRACT

An electrical connector configured to maintain an electrical connection with a conductor during heating and cooling cycles is provided. The electrical connector includes connector sections, each comprising a base portion and top portion extending from the base portion. Each connector section defines a portion of a channel configured to receive one or more conductors and includes a bore in its base or top portion that communicates with the channel. A fastener inserted into the bore is configured to retain the conductor inserted into the channel, and the top portions are configured to deflect substantially independently of each other to provide a spring force that secures the fastener against the conductor.

19 Claims, 6 Drawing Sheets

(56) References Cited

U.S. PATENT DOCUMENTS 8,277,263 B1 * 10/2012 Smith ..... H01R 4/32
439/779

2008/0166929 A1 * 7/2008 Fong ..... H01R 4/36
439/797

2009/0311897 A1 * 12/2009 Moist ..... H01R 4/36
439/271

* cited by examiner

ELECTRICAL CONNECTOR

BACKGROUND

Electrical power cables are common and employed for distributing power across power grids or networks, such as when moving electricity from power generation plants to electric power consumers. Power cables are conductors and generally include a conductive core (typically copper or aluminum) optionally surrounded by one or more layers of insulating material. The conductive core includes solid cores or a plurality of twisted conductive strands constructed to carry high voltages (greater than about 50,000 volts), medium voltages (between about 1,000-50,000 volts), or low voltages (less than about 1,000 volts).

Occasionally one desires to form a splice or a junction in the power cable to extend the cable or to distribute electricity to additional branches of the grid or network. Splices are commonly employed to deliver electricity to individual homes, businesses, and/or offices. For example, a "feeder line" supplying electrical power to a group of several buildings may be spliced or branched into one or more "service lines," each of which may be connected to one of the group of buildings being serviced. As used herein, the terms "splice" and "junction" are used interchangeably, and in each case refers to the portion of a power distribution system where an incoming cable connects to at least one outgoing cable.

Splices and junctions typically employ one or more electrical conductors. After the splice is formed and voltage is initiated, current flows through the feeder and service lines. During periods of high power demand, current flowing through the feeder and service lines will heat the conductors and the connectors. During periods of low power demand, current flowing through the feeder and service lines ceases or abates, and the conductors and connectors cool. Such cyclic heating and cooling can expand and contract the conducting components, potentially undesirably loosening the electrical connection between the connector and the feeder or service lines. Loose connector lines can reduce the electrical performance of the junction.

SUMMARY

At least one aspect of the present invention provides an electrical connector configured to maintain an electrical connection with a conductor during heating and cooling cycles.

At least one aspect of the present invention provides an electrical connector comprising at least two connector sections, each connector section comprising a base portion and a top portion, each base portion being integrally connected with adjacent base portions, and each top portion being at least partially disjoined from adjacent top portions, the base portions and top portions of the at least two connector sections defining at least one channel configured to receive at least one conductor, each connector section further having a bore hole in either its base portion or top portion, the bore hole being in communication with the channel and configured to receive a fastener, wherein when a fastener is tightened against a conductor in the channel, the top portions of the electrical connector are able to deflect away from their respective base portions independently of each other.

At least one aspect of the present invention provides a connector assembly comprising a connector defining at least one channel extending between opposing major faces of the connector body, at least two connector portions, each comprising a base portion extending between the at least one channel and an adjacent first side surface and a top portion extending between the at least one channel and an adjacent second side surface, one of the base portion and the top portion of each connector section defining a bore communicating with the at least one channel; a conductor inserted into the at least one channel; and means for deflecting each top portion to maintain force on the conductor within the at least one channel.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to one another. Like reference numerals designate correspondingly similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It will also be understood that features of the various exemplary embodiments described herein may be combined with each other, unless specifically noted otherwise.

At least one embodiment of the invention provides an electrical connector configured to maintain an electrical connection with one or more conductors during heating and cooling cycles. In one embodiment, the electrical connector includes at least two top portions sufficiently disjoined such that they can independently deflect and provide a compressive spring force to fasteners in contact with the one or more conductors. Other embodiments provide multiple connector sections, each including a top portion configured to maintain the compressive spring force of a fastener in contact with a conductor.

At least one embodiment of the invention provides a bus bar electrical connector including a plurality of channels and two or more top portions. Other embodiments provide a bus bar connector assembly that includes a feeder line inserted into an opening and one or more service lines exiting from one or more branch openings. The connector assembly serves as a junction for splicing an incoming feeder line to one or more outgoing service lines that branch across a grid to, for example, a neighborhood of homes or several businesses.

Although the connector sections of the electrical connectors of the present invention are described as having base portions and upper portions, there is not necessarily a distinct point at which the two meet. The location of the transition from one portion to another will depend on the particular embodiment and its features. For most embodiments of the present invention, the transition occurs in the vicinity of the channel 138. Most often the transition occurs in the vicinity of the bottom half or bottom three-quarters of the channel.

Figure 1:
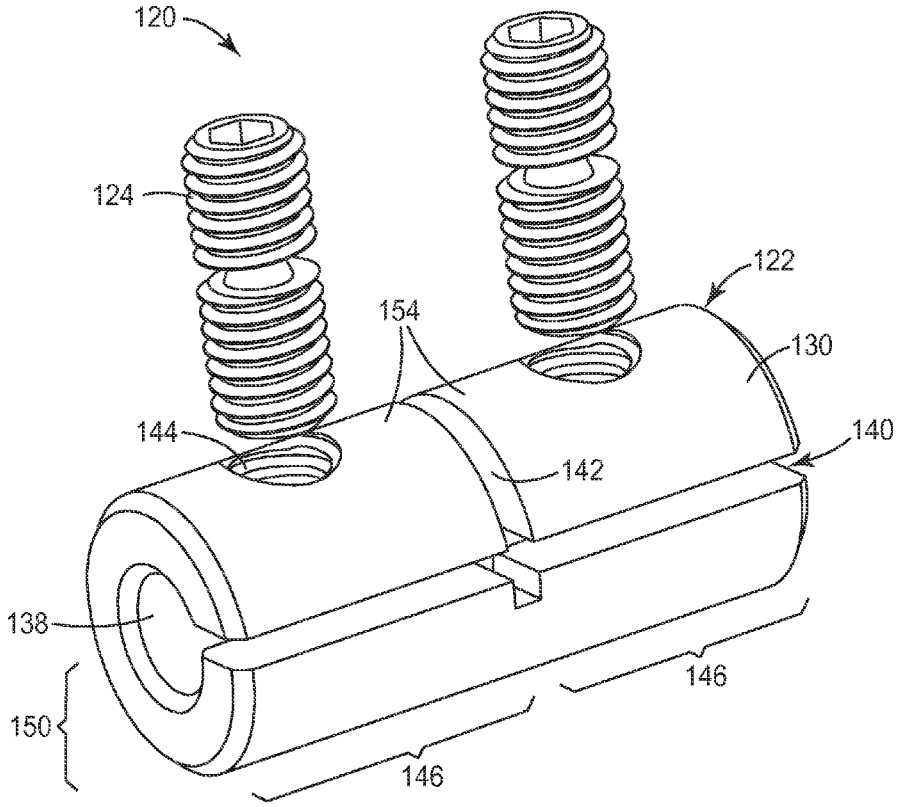
FIG. 1 is a perspective view of an electrical connector according to one embodiment of the invention.

FIG. 1 presents a perspective view of a generally C-shaped electrical connector 120 according to one embodiment of the present invention. Electrical connector 120 includes a body 122 configured to receive at least one conductor and two fasteners 124, in this case, shear fasteners, that may be inserted into body 122 to retain the conductor.

In at least one embodiment, electrical connector 120 comprises body 122 having a tubular shape generally defined by outer surface 130 and channel 138 extending along the central longitudinal axis of body 122. Electrical connector 120 further comprises a horizontal slot 140 extending along its length and creating an opening between channel 138 and outer surface 130 and a vertical slot 142 defining two adjacent connector sections 146. Each connector section 146 further comprises a bore 144 extending from outer surface 130 to channel 138. When a conductor is inserted into channel 138 and fastener 124 is secured against the conductor, a portion of body 122 is configured to store elastic potential energy and force fastener 124 against the conductor such that electrical connection is maintained between body 122 and the conductor during cyclical heating and cooling of connector 120 and conductor (not shown).

In at least one embodiment of the present invention, body 122 includes a base portion 150 and top portions 154 extending from base portion 150. Top portions 154 are defined at least in part by channel 138, outer surface 130, horizontal slot 140, and vertical slot 142. In one embodiment, top portions 154 are cantilevered from base portion 150. Load supporting sections of top portions 154 are decoupled from, and enabled to move relative to, base portion 150 and each other. The cantilevered top portions 154 are configured to independently move and/or flex to accommodate the expansion or contraction of different portions of body 122 of connector 120 and of one or more conductors (not shown) inserted into channel(s) 138 as the conductors and connector 120 cyclically heat and cool.

In this specification, the term "cantilevered" refers to a structure extending from and supported by a base portion and including a load supporting section that is substantially opposite the base portion.

Figure 3A:
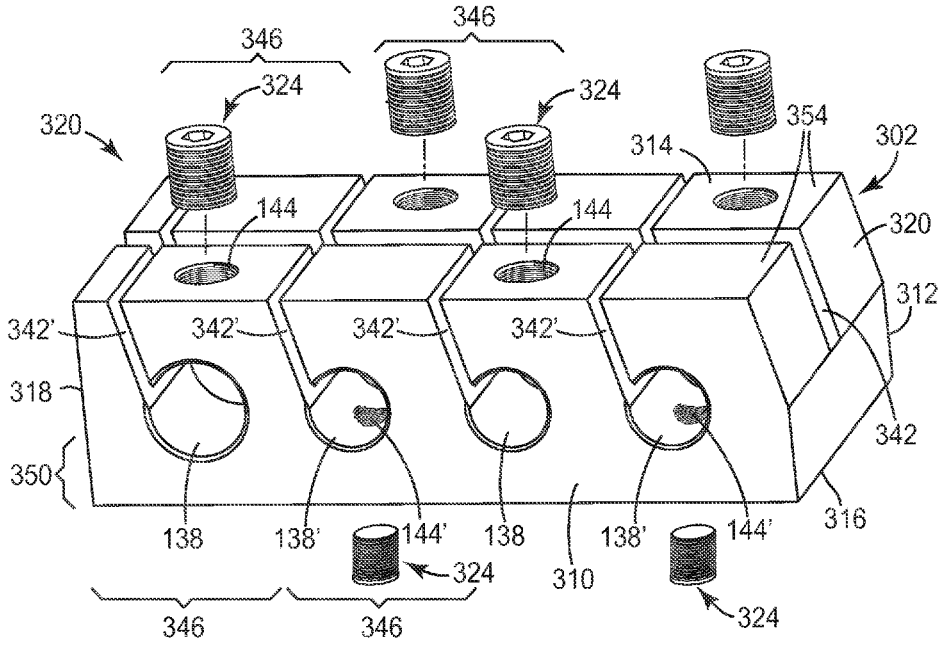
FIG. 3A is a perspective view of an electrical connector according to a third embodiment of the invention.

In at least one embodiment, bores 144 are formed in top portions 154 and extend between outer surface 130 and channel 138. Bores 144 are sized to receive fastener 124, and in at least one embodiment includes a threaded bore sized to receive threaded set screw-styled fastener 124. Other locations for bores 144 and other fastening mechanisms are also contemplated and considered acceptable, such as is illustrated in FIG. 3A.

Electrical connector 120 is configured to provide and maintain an electrical connection with a conductor inserted into channel 138. Suitable materials for body 122 of electrical connector 120 generally include electrically conductive metals that will deflect under the force of fastener 124 to provide a return spring force. One suitable material for fabrication of body 122 is aluminum, although other metals such as copper, alloys of copper, alloys of aluminum, or bronze are also acceptable. In some embodiments, the material is preferably creep resistant.

Fastener 124 includes any suitable fastener configured to interlock with body 122 and provide sufficient compression against a conductor inserted into channel 138 in a manner that will deflect top portions 154. One suitable fastener 124 includes a shear fastener. Suitable fasteners include bolts, headed screws, threaded fasteners, set screws, and the like. In one embodiment, fastener 124 is selected to have similar electrical properties and a similar coefficient of thermal expansion as body 122. One suitable material for fastener 124 is aluminum, although other metals such as stainless steel, steel, copper alloys such as brass, and zinc alloys, such as Zamak (or Zamac) which include alloys of zinc with, e.g., aluminum, magnesium, and copper, are also suitable. Suitable non-metal materials may include Bakelite (polyoxybenzylmethyleneglycolanhydride) and polyamide-imides available under the trade name TORLON from Solvay Advanced Polymers.

In another embodiment of the invention, body 122 is fabricated from a first conductive metal and fastener 124 is fabricated from a second (different) conductive metal. In one embodiment, for example, body 122 is fabricated of aluminum and fastener 124 is fabricated of stainless steel. This embodiment may be suitable for use in an enclosed transformer box. In other embodiments, body 122 may be fabricated of bronze when electrical connector 120 is employed in or exposed to oxidative or corrosive environments.

Figure 2A:
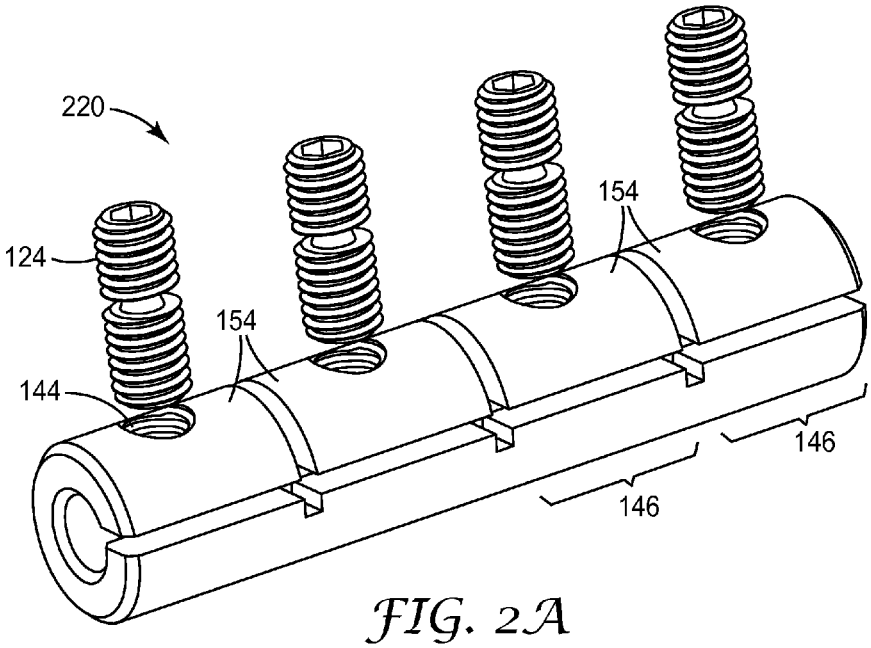
FIG. 2A is a perspective view of an electrical connector according to a second embodiment of the invention.
Figure 2B:
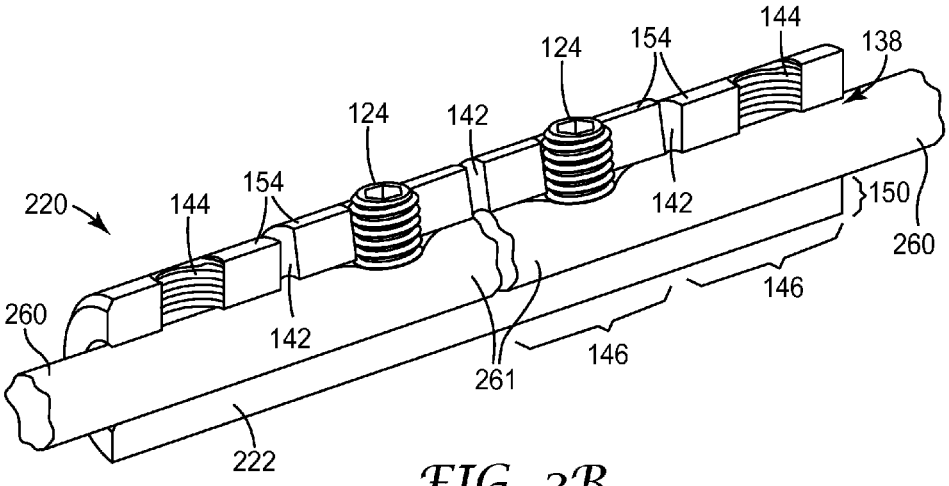
FIG. 2B is a cut-away view of the electrical connector of FIG. 2A having electrical connectors fastened therein.

Electrical connector 220 of FIG. 2A is similar to electrical connector 120 except that it has four connector sections 146 instead of two. FIG. 2B presents a cross-section of electrical connector 220 in which two conductors 260 have been inserted and are being held in place by fasteners 124. Insulation, if provided on conductors 260, can be removed to enable electrical connection between conductors 260 and body 222. Conductors 260 may include solid metal conductors, conductor strands, braided strands of conductors, and the like. As illustrated in FIG. 2B, fasteners 124 located in the two inner bores 144 have been tightened against conductors 260 with a sufficient force to deflect the two inner top portions 154 upward away from base portion 150. The illustrated fasteners 124 are shear fasteners, the upper portions of which have been sheared off upon tightening. In one embodiment, fasteners 124 are fasteners capable of exerting a torque of between about 1 N-m (10 lb-in) and about 40 N-m (360 lb-in) relative to connector 220.

While not bound to any particular theory of operation, it is believed that the mechanical energy employed in securing fasteners 124 against conductors 260 is elastically stored in connector 220 when top portions 154 are deflected away from base portion 150 thus providing a spring force (and thereby stores potential energy) to top portions 154 that is transferred through fastener 124 onto conductor 260. Heating and cooling cycles can be expected to thermally expand and contract connector 220 and conductor 260. Top portions 154, however, provide a spring force that secures fasteners 124 against conductors 260 during the heating and cooling cycles and maintains an electrical connection between conductor 260 and body 222. If conductors 260 are, for example, strands or braided strands, it is likely that the portion of conductor 260 nearest the terminated end 261 will be more likely to splay when compressed by the force of fasteners 124. Having separate connector sections 146 for the terminated ends 261 of conductors 260 and for portions of conductor 260 not subject to such splaying allows electrical connector 220 to accommodate the different properties of the different portions of conductor 260 when they are subjected to heating and cooling cycles.

In this embodiment, as well as other embodiments, connector sections 146 need not be the same size (typically length would vary). For example, the two inner connector sections 146 might be shorter or longer (in a horizontal direction) than the two outer connector sections 146. The sizes of the individual connector sections can be modified as needed to suit a particular application.

FIG. 3A provides a perspective view of an electrical connector 320 according to another embodiment of the invention. Here electrical connector 320 includes bus bar 302 and fasteners 324 configured to secure conductors that may be spliced through bus bar 302.

Bus bar 302 includes opposing major faces 310, 312 extending between opposing first and second side surfaces 314, 316 and opposing ends 318, 320. In one embodiment, bus bar 302 defines multiple channels 138 extending between major faces 310, 312. Primary vertical slot 342 extends from end 318 to end 320 and intersects with each channel 138. Each channel 138 further communicates with a secondary vertical slot 342' which extends from each channel 138 to first side surface 314. Primary and secondary vertical slots 342 and 342' substantially define top portions 354 in electrical connector 320. In the embodiment of FIG. 3A, bus bar 302 includes eight top portions 354, but may include any suitable number of top portions. In one embodiment, bus bar 302 includes a base portion 350 and top portions 354 extending from base portion 350. In one embodiment, top portions 354 are cantilevered from base portion 350. Top portions 354 are substantially decoupled from, and enabled to move relative to, base portion 350 and each other. The cantilevered top portions 354 are configured to independently move and/or flex to accommodate the expansion or contraction of different portions of bus bar 302 and inserted conductors (not shown) as connector 320 and any inserted conductors cyclically heat and cool.

Channels 138 are sized to receive conductors. The diameter of the channels 138 need not be the same as is illustrated in FIG. 3A, although channels having equal diameters are possible depending upon the desired end application. Four channels 138 are shown in FIG. 3A, although it is within the scope of this disclosure to provide for any number of suitable openings 138, ranging from 2 to 8 or more. Non-limiting representative sizes for the diameter of channels 138 can range from about 3.175 mm (0.125 in.) to about 31.75 mm (1.25 in.) to accommodate the diameter of an incoming feeder line and outgoing service lines, for example, although other sizes for the diameters are also considered acceptable.

Top portions 354 are configured to deflect or displace in response to one of the fasteners 124 secured against a conductor inserted into a channel 138. In the embodiment of FIG. 3A, only some connector sections 346 have top portions 354 that include a bore 144 configured to receive fastener 324. In the remaining connector sections 346, bores 144' configured to receive fastener 324 are located in base section 350 and extend from second side surface 316 to channel 138. In such embodiments, when a conductor is inserted into a channel 138 and secured with a fastener 324 residing in a bore 144 or 144', an affected top portion 354 deflects away from the base section 350 as the fastener 324 presses against the conductor. This deflection occurs whether the fastener 324 is inserted through the base portion 350 and tightened toward a top portion 354 or whether the fastener 324 is inserted through a top portion 354 and tightened toward base portion 350. To this end, top portions 354 provide a spring force that secures fasteners 324 against the portion of the conductors within each connector section 346 of electrical connector 320 as bus bar 302 and the connectors thermally expand or contract during heating and cooling cycles.

Suitable materials for fabricating bus bar 302 and fasteners 324 include those conductive materials described above for electrical connector 120. In one embodiment, bus bar 302 may be fabricated of aluminum and configured to provide suitable electrical conductivity for a branch splice connector. In another embodiment, bus bar 302 may be fabricated of bronze and suited for use as a grounding junction block useful, for example, on cellular towers and/or underground junctions.

Figure 3B:
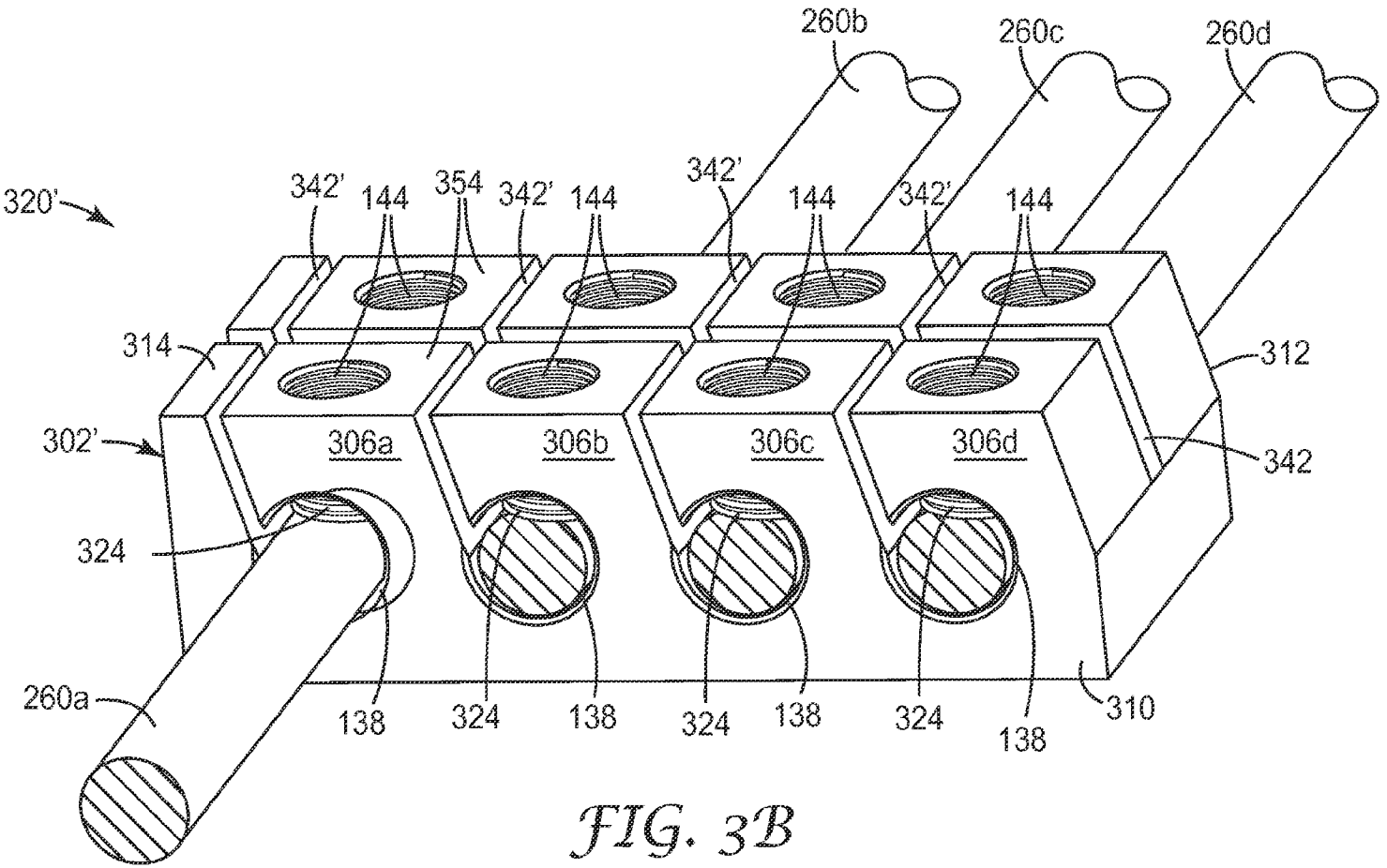
FIG. 3B is a perspective view of a variation of the third embodiment of the electrical connector of the invention.

FIG. 3B provides a perspective view of electrical connector 320', which is a variation of the electrical connector 320. For electrical connector 320', each top portion 354 includes a bore 144 configured to receive a fastener 324 and extending from first side surface 314 to channel 138. Electrical connector 320' is suitable for use in applications such as an electrical splice application branching service lines to a neighborhood. In such an application, for example, conductors 260*a*-260*d* can include aluminum core conductors and electrical connector 320' may be fabricated of aluminum.

In one embodiment, electrical connector assembly 320' forms a feeder line splice assembly, where conductor 260*a* represents an incoming feeder line that is electrically spliced to three outgoing service line conductors 260*b*, 260*c*, and 260*d*. In an exemplary embodiment, feeder line conductor 260*a* is an aluminum conductor sized to provide about 1000 kcmils service, and the three service conductors 260*b*-*d* are sized to provide about 250 kcmils service branched to an individual house or business. Electrical connector 320' may be formed of aluminum to provide a low cost aluminum block distribution bus compatible with the aluminum feeder line and service lines. Other materials are also, however, considered acceptable and their particular selection will largely depend on end-user's specifications.

Figure 4A:
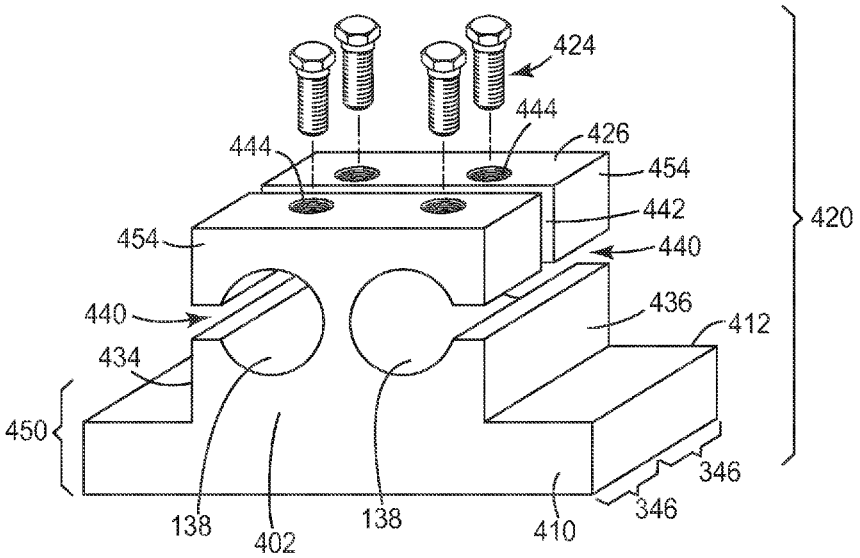
FIG. 4A is a perspective view of an electrical connector according to a fourth embodiment of the invention.

FIG. 4A provides a perspective view of electrical connector 420 according to still another embodiment of the invention. Electrical connector 420 provides a two-hole splice connector that includes body 402 defining channels 138 configured to receive conductors, fasteners 424 configured to be fastened against the conductors, and top portions 454 configured to deflect when fasteners 424 are tightened against the conductors in a manner that provides a spring force that secures fasteners 424 against the conductors.

In at least one embodiment, body 402 is fabricated from an electrically conducting metal such as aluminum and includes channels 138 extending between opposing major faces 410 and 412 of body 402. Fasteners 424 are configured to be selectively tightened against conductors inserted into channels 138. Fasteners 424 may be in the form of fasteners similar to shear bolts 124 or threaded set screws 324 described above or may include the illustrated bolts. Other suitable fasteners may also be employed.

Bores 444 are formed in side 426 of body 402 and communicate with channels 138. Each channel 138 is associated with two bores 444 sized to receive a fastener 424 selected to ensure a suitably large force delivered by fasteners 424 against an inserted conductor. Dual fasteners 424 for each channel 138 ensure that top portions 454 will adequately deflect and provide a spring force to secure fasteners 424 against the conductor during the heating and cooling cycles.

Figure 5:
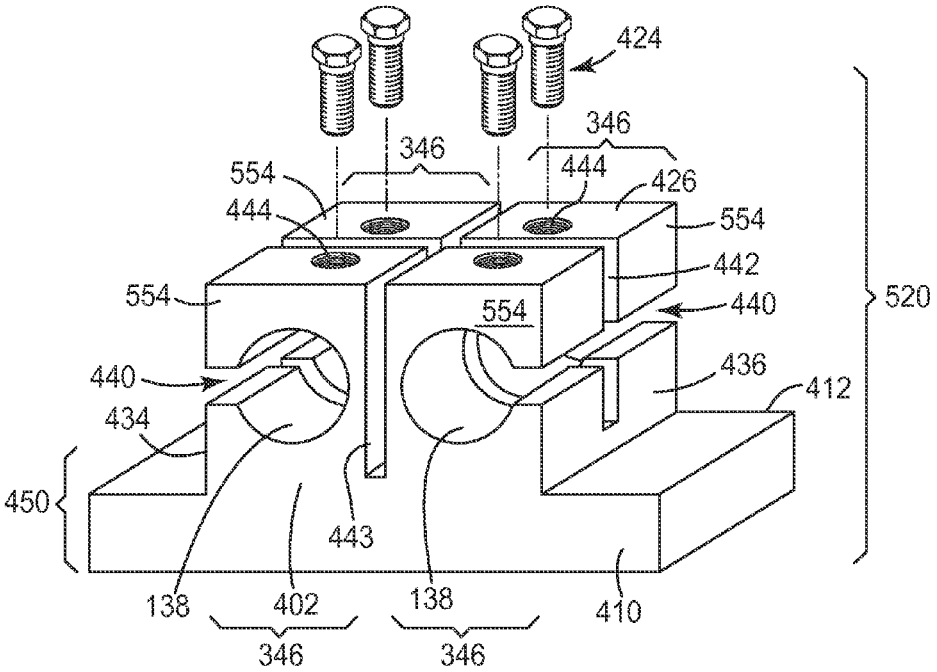
FIG. 5 is a perspective view of an electrical connector according to a fifth embodiment of the invention.

In the embodiment illustrated in FIG. 4A, each top portion 454 is defined in part by a channel 138 and a horizontal slot 440 formed inside 434 or side 436 of body 402 to communicate with channel 138. Each top portion 454 is further defined by vertical slot 442, which extends vertically from side 426 into body 402 to about the middle of channel 138, and also extends laterally from side 434 to side 436. Vertical slot 442 may extend any suitable distance into body 402 (measured from side 426 to the bottom of base section 450). It may extend as little as about 25% into body 402, may extend an intermediate distance such as about 50% into body 402, or may extend to, or almost to, or into base portion 450, i.e., about 75% or more, as is illustrated in FIG. 5. Horizontal and vertical slots 440 and 442 decouple a portion of each top portion 454 from body 402 to enable top portions 454 to move during heating and cooling cycles. For example, top portions 454 are cantilevered relative to base portion 450 of body 402 and are configured to flex toward (i.e., "contract") and away (i.e., "expand") from base portion 450 to provide cantilevered top portions 454 that accommodate heating and cooling cycles of connector 420 and connector (not shown). Because each top portion 454 in the embodiment of FIG. 4A accommodates fasteners extending into portions of two adjacent channels, top portions 454 cannot flex as easily as the top portions in other embodiments which accommodate single fasteners. This can be mitigated by e.g., making the upper portion of top portion 454 thinner or by using more flexible materials to make the connectors.

Figure 4B:
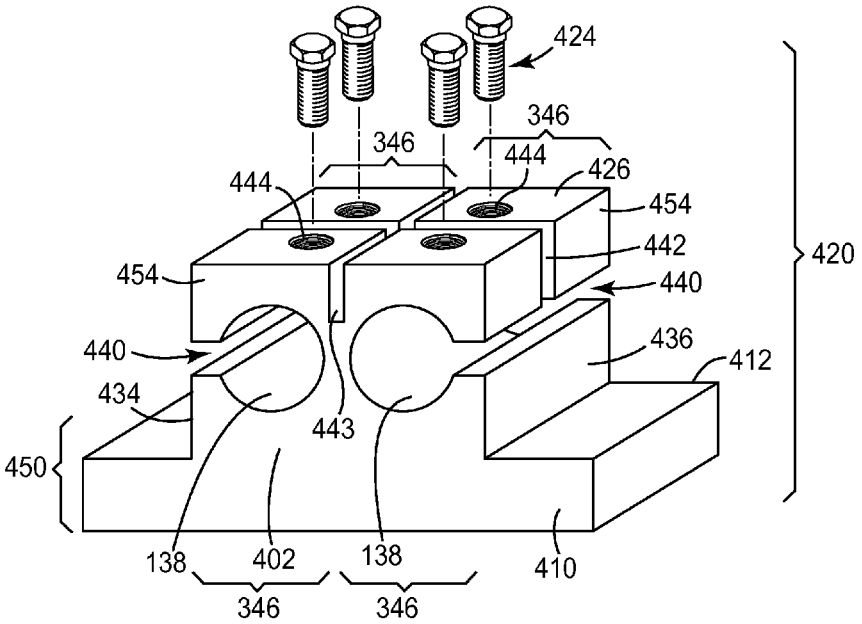
FIG. 4B is a perspective view of a variation of the fourth embodiment of the electrical connector of the invention.

FIG. 4B provides a perspective view of an alternate embodiment of electrical connector 420. In the embodiment illustrated in FIG. 4B, electrical connector 420 further comprises a second vertical slot 443, which extends vertically from side 426 into body 402. Vertical slot 443 may extend any suitable distance into body 402. It may extend as little as about 25% into body 402, may extend an intermediate distance such as about 50% into body 402, or may extend to, or almost to, or into base portion 450, i.e., about 75% or more, as is illustrated in FIG. 5. Vertical slot 443 also extends laterally from face 410 to face 412, thereby bisecting vertical slot 442. Horizontal slots 440 and vertical slots 442 and 443 substantially define four top portions 454 and in conjunction with a channel 138 decouple a portion of each top portion 554 from body 402 to enable top portions 554 to move independently during heating and cooling cycles. The deeper the vertical slots 442 and 443, the more top portions 454 can move independently of each other and of the base portion 450. The slots of the embodiment illustrated in FIG. 4B at least partially define four connector sections 346.

Figure 4C:
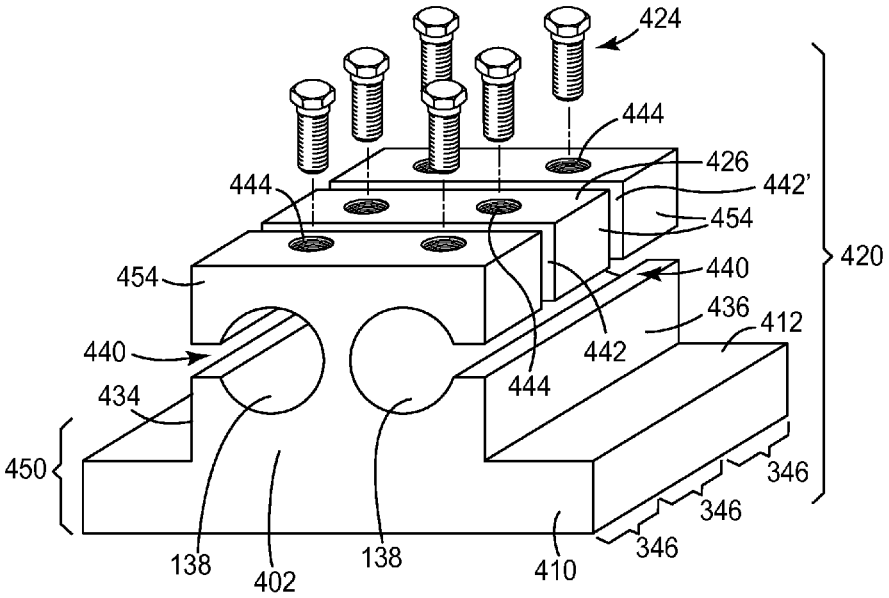
FIG. 4C is a perspective view of a variation of the fourth embodiment of the electrical connector of the invention.

FIG. 4C provides a perspective view of yet another alternate embodiment of electrical connector 420. In the embodiment illustrated in FIG. 4C, electrical connector 420 further comprises a second vertical slot 442', which is non-intersecting, and in the illustrated embodiment parallel or essentially parallel, to vertical slot 442. Vertical slot 442' extends vertically from side 426 into body 402 to about the middle of channel 138, and also extends laterally from side 434 to side 436. In conjunction with channel 138 and a horizontal slot 440, vertical slot 442' at least partially defines a third top portion 454 and a third connector section 346.

FIG. 5 provides a perspective view of electrical connector 520 according to still another embodiment of the invention. Electrical connector 520 is a two-hole splice connector similar to electrical connector 420. However, electrical connector 520 further comprises a second vertical slot 443, which extends vertically from side 426 into body 402 and to, or into, base portion 450, and also extends laterally from face 410 to face 412, thereby bisecting vertical slot 442, which also extends to, or into, base portion 450. Horizontal slots 440 and vertical slots 442 and 443 substantially define four top portions 554 and in conjunction with a channel 138 decouple a portion of each top portion 554 from body 402 to enable top portions 554 to move independently during heating and cooling cycles. For example, top portions 554 are cantilevered relative to base portion 450 of body 402 and are configured to flex toward (i.e., "contract") and away (i.e., "expand") from base portion 450 to provide cantilevered top portions 554 that accommodate heating and cooling cycles of connector 520 and conductor.

Depending on a particular chosen end-use environment, the electrical connector may include an uninsulated electrically conductive body suited for electrically splicing one or more conductors. In other embodiments more appropriate for other end-uses, the electrical connector includes an insulated conductive body, i.e., the exposed exterior surfaces of the conductive body are covered with an electrical insulator. The insulator may be applied over all exterior surfaces of the conductive body to provide electrical insulation to the body. Preferably, the insulator is not fully coated in the channels or bores such that body can electrically communicate with a conductors inserted into the channels.

Suitable materials for the insulator include materials having low electrical conductivity (i.e., insulators) such as plastics, plastics with fillers, thermoplastics, thermoformable (cured) plastics, moldable rubbers, and the like. In one embodiment, the insulator includes a plastisol formed of a dispersion of a vinyl polymer in a suitable solvent. The insulator is preferably configured to cure to a solid at room temperature and provide a chemically-resistant insulating coating over the exterior surfaces of the body. Suitable plastisols are available from Lakeside Plastics, Inc., Oshkosh, Wis.

Various embodiments of the invention provide an electrical splice connector having at least one top portion configured to maintain an electrical connection with a conductor during heating and cooling cycles. Other embodiments of the invention provide bus bar electrical connectors that include a plurality of openings and a plurality of top portions each disposed between adjacent openings. Such connectors are configured to provide a junction or splice between an incoming feeder line and one or more outgoing service lines that branch across a grid to deliver electricity to a neighborhood of homes or several businesses.

Although specific embodiments have been illustrated and described herein, it will be appreciated by those of ordinary skill in the art that a variety of alternate and/or equivalent implementations may be substituted for the specific embodiments illustrated and described without departing from the scope of the invention. This application is intended to cover any adaptations or variations of electrical connectors, bus bars, and connector assemblies as discussed herein. Therefore, it is intended that this invention be limited only by the claims and the equivalents thereof.

What is claimed is:

1. An electrical connector comprising:

at least two connector sections, each connector section comprising a base portion and a top portion, each base portion being integrally connected with adjacent base portions, and each top portion being at least partially disjoined from adjacent top portions, the base portions and top portions of the at least two connector sections defining at least one channel configured to receive at least one conductor, wherein each channel is defined by at least two disjoined top portions that deflect independently of each other, each connector section further having a bore hole in either its base portion or top portion, the bore hole being in communication with the channel and configured to receive a fastener, wherein when a fastener is tightened against a conductor in the channel, the top portions of the electrical connector are able to deflect away from their respective base portions independently of each other while being in contact with the at least one conductor, wherein the at least two top portions are partially defined by a horizontal slot extending along the length of and communicating with the channel and at least one vertical slot intersecting the channel.

2. The electrical connector of claim 1 wherein the cross-section of the electrical connector is C-shaped.

3. The electrical connector of claim 1, wherein the top portions of the at least two connector sections are partially defined by a first vertical slot intersecting the at least one channel and a second vertical slot communicating with the at least one channel.

4. The electrical connector of claim 3 comprising at least four connector sections and at least two non-intersecting channels, wherein the at least four top portions are partially defined by a first vertical slot intersecting the at least two non-intersecting channels and at least two second vertical slots, each second vertical slot communicating with one of the channels.

5. The electrical connector of claim 1 comprising at least two connector sections, each connector section having a top portion and a base portion and defining a portion of two non-intersecting channels, wherein the at least two top portions are partially defined by a vertical slot intersecting the two non-intersecting channels and two horizontal slots, each horizontal slot extending along the length of and communicating with one of the channel.

6. The electrical connector of claim 5 comprising at least three connector sections, each connector section having a top portion and a base portion and defining a portion of two non-intersecting channels, wherein the at least three top portions are partially defined by at least two non-intersecting vertical slots intersecting the two non-intersecting channels and two horizontal slots, each horizontal slot extending along the length of and communicating with one of the channel.

7. The electrical connector of claim 1 comprising at least four connector sections and two non-intersecting channels, wherein the top portions of the at least four connector sections are partially defined by at least one first vertical slot between the non-intersecting channels, at least one second vertical slot that intersects the two non-intersecting channels and the first vertical slot, and at least two horizontal slots, each horizontal slot extending along the length of and communicating with one of the channels.

8. The electrical connector of claim 7 comprising at least six connector sections and two non-intersecting channels, wherein the top portions of the at least six connector sections are partially defined by at least one first vertical slot between the channels, at least two second vertical slots that intersects the two non-intersecting channels and the first vertical slot, and at least two horizontal slots, each horizontal slot extending along the length of and communicating with one of the channels.

9. The electrical connector of claim 1 wherein when a fastener is tightened against a conductor in the channel, the top portions of the electrical connector are able to deflect away from their respective base portions independently of each other thereby providing a spring force that secures each fastener against a conductor in the channel.

10. The electrical connector of claim 1, further comprising:

electrical insulation material disposed on exterior surfaces of the base portion and the top portions.

11. The electrical connector of claim 1, wherein the electrical connector is a bus bar.

12. The electrical connector of claim 11 wherein the bus bar comprises at least six connector sections and at least three non-intersecting channels, and wherein at least one channel comprises a feeder channel having a first diameter and at least two channels comprise service channels each service channel having a diameter less than the first diameter.

13. The bus bar of claim 12, wherein at least one of the top portions defines a bore extending from the first side surface to a respective one of the channels.

14. The bus bar of claim 12, wherein at least one base portion defines a bore extending from the second side surface to a respective one of the channels.

15. A connector assembly comprising:

a connector defining:

at least one channel extending between opposing major faces of the connector body, at least two connector portions, each comprising a base portion extending between the at least one channel and an adjacent first side surface and a top portion extending between the at least one channel and an adjacent second side surface, one of the base portion and the top portion of each connector section defining a bore communicating with the at least one channel, wherein each channel is defined by more than one disjoined top portion that deflect independently of each other, each connector section further having a bore hole in either its base portion or top portion, the bore hole being in communication with the channel and configured to receive a fastener, wherein when a fastener is tightened against a conductor in the channel, the top portions of the electrical connector are able to deflect away from their respective base portions independently of each other while being in contact with the at least one conductor, wherein the at least two top portions are partially defined by a horizontal slot extending along the length of and communicating with the channel and at least one vertical slot intersecting the channel;

a conductor inserted into the at least one channel; and means for deflecting each top portion to maintain force on the conductor within the at least one channel.

16. The connector assembly of claim 15, wherein the means for deflecting the top portion comprises forcing a fastener inserted into a bore formed in a top portion into contact with the conductor.

17. The connector assembly of claim 15, wherein the means for deflecting the top portion comprises forcing a fastener inserted into a bore formed in a base portion into contact with the conductor.

18. The connector assembly of claim 15, wherein the means for deflecting the top portion comprises threaded means for moving the top portion away from the base portion.

19. The connector assembly of claim 18, wherein moving the top portion away from the base portion comprises storing spring energy in the top portion.

* * * * *